US009093799B2

(12) United States Patent
Kiribayashi

(10) Patent No.: US 9,093,799 B2
(45) Date of Patent: Jul. 28, 2015

(54) CONNECTOR APPARATUS

(71) Applicant: DENSO CORPORATION, Kariya, Aichi-pref. (JP)

(72) Inventor: Shinichi Kiribayashi, Anjo (JP)

(73) Assignee: DENSO CORPORATION, Kariya (JP)

( * ) Notice: Subject to any disclaimer, the term of this patent is extended or adjusted under 35 U.S.C. 154(b) by 39 days.

(21) Appl. No.: 14/065,892

(22) Filed: Oct. 29, 2013

(65) Prior Publication Data

US 2014/0141627 A1 May 22, 2014

(30) Foreign Application Priority Data

Nov. 22, 2012 (JP) ..... 2012-255999

(51) Int. Cl.
*H01R 12/00* (2006.01)
*H01R 12/72* (2011.01)
*H01R 12/57* (2011.01)

(52) U.S. Cl.
CPC ..... *H01R 12/725* (2013.01); *H01R 12/57* (2013.01)

(58) Field of Classification Search
USPC ..... 439/55
See application file for complete search history.

(56) References Cited

U.S. PATENT DOCUMENTS

| | | | | |
|---|---|---|---|---|
| 3,493,916 | A * | 2/1970 | Hansen | 439/79 |
| 4,186,988 | A * | 2/1980 | Kobler | 439/676 |
| 4,210,376 | A * | 7/1980 | Hughes et al. | 439/676 |
| 4,410,230 | A * | 10/1983 | SanMiguel | 439/682 |
| 4,721,472 | A | 1/1988 | Gentry et al. | |
| 6,643,143 | B1 * | 11/2003 | Stewart et al. | 361/828 |
| 7,156,688 | B2 * | 1/2007 | Nakano et al. | 439/417 |
| 7,726,982 | B2 * | 6/2010 | Ngo | 439/79 |
| 7,731,520 | B1 * | 6/2010 | Daily et al. | 439/357 |
| 2008/0207058 | A1 | 8/2008 | Zhu et al. | |
| 2009/0124107 | A1 | 5/2009 | Zhu | |
| 2010/0279534 | A1 * | 11/2010 | Byrnes et al. | 439/329 |
| 2011/0008975 | A1 * | 1/2011 | Yamaji et al. | 439/55 |

FOREIGN PATENT DOCUMENTS

| | | |
|---|---|---|
| JP | 61-157388 | 9/1986 |
| JP | 03-044882 | 4/1991 |
| JP | 04-072488 | 6/1992 |
| JP | 11-354225 | 12/1999 |
| JP | 2007-087748 | 4/2007 |

OTHER PUBLICATIONS

Office Action dated Sep. 2, 2014 in corresponding Japanese Application No. 2012-255999.

* cited by examiner

*Primary Examiner* — Jean F Duverne
(74) *Attorney, Agent, or Firm* — Harness, Dickey & Pierce, PLC

(57) ABSTRACT

A first connector is surface mounted to a mount surface of a printed circuit board through a plurality of lead terminals and at least one peg element. A second connector is engageable and disengageable relative to the first connector through insertion and removal, respectively, of one of the first connector and the second connector relative the other one of the first connector and the second connector. At least one of the first connector and the second connector includes at least one engaging projection, which projects from an outer surface of the at least one of the first connector and the second connector and is engaged with the printed circuit board.

7 Claims, 2 Drawing Sheets

CONNECTOR APPARATUS

CROSS REFERENCE TO RELATED APPLICATION

This application is based on and incorporates herein by reference Japanese Patent Application No. 2012-255999 filed on Nov. 22, 2012.

TECHNICAL FIELD

The present disclosure relates to a connector apparatus.

BACKGROUND

A surface mount technology (SMT) connector, which is surface mounted to a mount surface of a printed circuit board, is widely used to electrically connect the printed circuit board to another printed circuit board or an external electric device. The SMT connector eases formation of an electrical connection of the SMT connector to a device mounted on the printed circuit board and enables arrangement of contacts of the SMT connector at a high density. A soldering portion (a lead terminal) of each contact of the SMT connector is soldered to a corresponding land formed on the mount surface of the printed circuit board, so that the SMT connector is electrically connected to the printed circuit board. For instance, JP2007-87748A teaches pegs (also referred to as legs), which are installed to a housing of an SMT connector having a plurality of contacts. The pegs hold the housing relative to a printed circuit board, thereby increasing a holding force for holding the housing relative to the printed circuit board with the pegs.

In the SMT connector of JP2007-87748A, the pegs project from two longitudinal end surfaces, respectively, of the housing, which are opposed to each other in a longitudinal direction of the housing. Furthermore, these pegs extend in a width direction of the housing, which is perpendicular to the longitudinal direction. Each peg is formed by bending a metal plate member into an L-shape. One end portion of each peg configured into the L-shape is embedded into the corresponding longitudinal end surface of the housing, and the other end portion of the peg is exposed from the corresponding longitudinal end surface of the housing. A bottom surface part of the other end portion of the peg contacts the mount surface of the printed circuit board (more specifically, a corresponding land of the mount surface of the printed circuit board) when the SMT connector is mounted to the mount surface of the printed circuit board, and then the bottom surface part of the peg is soldered to the corresponding land formed on the mount surface of the printed circuit board. Therefore, the SMT connector is fixed to the printed circuit board in the stable manner.

However, in the case of JP2007-87748A where the SMT connector is fixed to the printed circuit board through the pegs, the following disadvantage may be encountered. Specifically, the pegs are securely soldered to the corresponding lands, respectively, formed on the mount surface of the printed circuit board. A stress (e.g., a stress similar to one shown in and discussed with reference to FIG. 5 later) may be exerted to the pegs in a direction perpendicular to a plane of the printed circuit board and may be caused by an inserting or removing force of a mating connector (a second connector) relative to the SMT connector or a weight or tension of an electrical conductive line, which is connected to the mating connector. The stress may possibly cause disconnection of the soldered connection between the land and the peg, so that the holding force of the pegs for holding the housing of the SMT connector to the printed circuit board may be reduced. Thereby, a stress may be also applied to a soldered connection between each lead terminal of the SMT connector and the corresponding land of the printed circuit board. Therefore, a crack may be formed in the solder, which connects between the lead terminal and the land, possibly causing a failure of the electrical connection.

In order to improve the peel strength of the peg relative to the land, it may be conceivable to change the amount of applied solder, or the configuration of the peg and/or the land. However, in such a case, the strength designing may become difficult.

SUMMARY

The present disclosure is made in view of the above disadvantages. According to the present disclosure, there is provided a connector apparatus, which includes a first connector and a second connector. The first connector is surface mounted to a mount surface of a printed circuit board through a plurality of lead terminals and at least one peg element of the first connector. The second connector is engageable and disengageable relative to the first connector through insertion and removal, respectively, of one of the first connector and the second connector relative the other one of the first connector and the second connector. At least one of the first connector and the second connector includes at least one engaging projection, which projects from an outer surface of the at least one of the first connector and the second connector and is engaged with the printed circuit board.

BRIEF DESCRIPTION OF THE DRAWINGS

The drawings described herein are for illustration purposes only and are not intended to limit the scope of the present disclosure in any way.

DETAILED DESCRIPTION

An embodiment of the present disclosure will be described with reference to the accompanying drawings.

Figure 1:
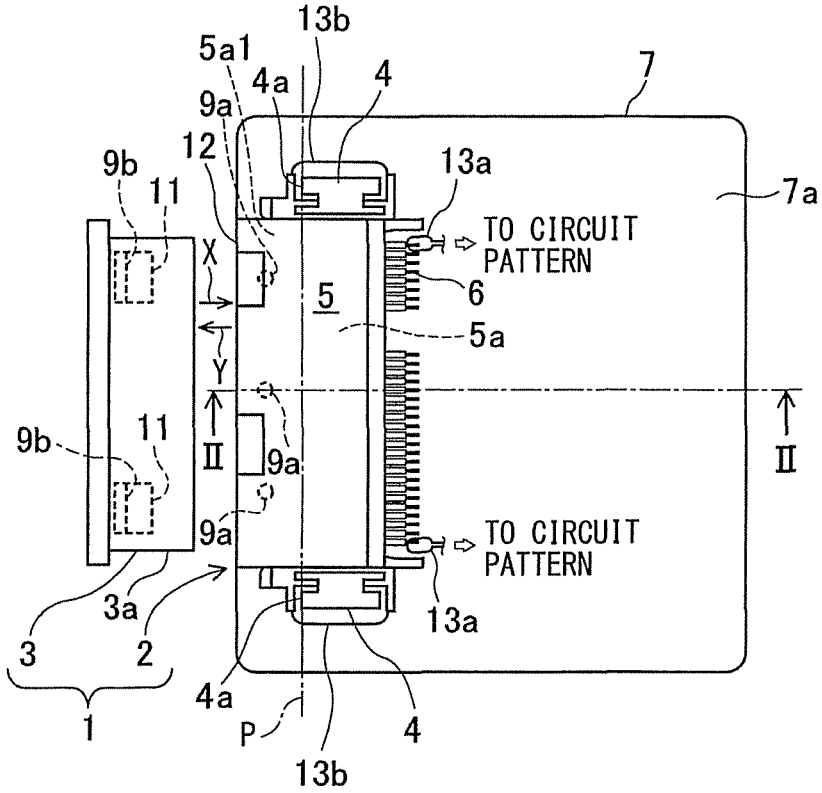
FIG. 1 is a plan view of a printed circuit board having a first connector of a connector apparatus of an embodiment of the present disclosure.

As shown in FIG. 1, a connector apparatus 1 includes a first connector 2 and a second connector 3. The first connector 2 is formed as a male connector, and the second connector 3 is formed as a female connector. The second connector 3 (more specifically, a housing 3*a* of the second connector 3) is insertable into a housing 5 of the first connector 2 in an inserting direction X through an insertion opening (also referred to as an inserting and removing opening) 12 of the housing 5 of the first connector 2. The second connector 3 is also removable from the housing 5 of the first connector 2 in a removing direction Y, which is opposite from the inserting direction X. Thereby, the first connector 2 and the second connector 3 are connectable and disconnectable relative to each other (i.e., engageable and disengageable relative to each other).

Figure 2:
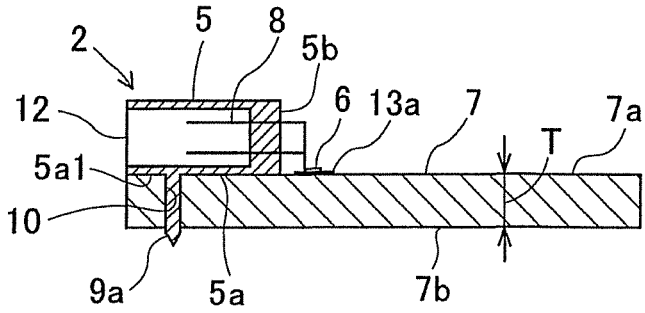
FIG. 2 is a cross-sectional view taken along a line II-II in FIG. 1, showing a state where the first connector of the connector apparatus is engaged with the printed circuit board.

As shown in FIGS. 1 and 2, the first connector 2 includes the housing 5, a plurality of contacts 8 and a plurality of peg elements (also referred to as peg terminals) 4. The housing 5 is configured into an elongated box form and is made of a dielectric material (e.g., a synthetic resin material). The housing 5 has the insertion opening 12. The contacts 8 are aligned with each other at a bottom portion 5*b* of the housing 5. Here, the insertion opening 12 is formed in one end portion of the housing 5 in a direction parallel to the inserting direction X of the second connector 3, and the bottom portion 5*b* is formed in the opposite end portion of the housing 5, which is opposite from the insertion opening 12 in the direction parallel to the inserting direction X of the second connector 3. The contacts 8 are fitted into contacts (not shown), respectively, of the second connector 3 to connect the contacts of the second connector 3 to a circuit of a printed circuit board 7. In the present embodiment, the number of the peg elements 4 is two (thereby serving as first and second peg elements 4). However, the number of the peg elements 4 is not limited to two and may be reduced to one or increased to more than two depending on a case. The peg elements (the first and second peg elements) 4 are respectively installed to two longitudinal end parts (first and second end parts) of the housing 5, more specifically, two longitudinal end surfaces of the housing 5, which are opposed to each other in a longitudinal direction (a top-to-bottom direction in FIG. 1) of the housing 5, i.e., a direction perpendicular to the inserting direction X of the second connector 3. Thereby, the housing 5 is fixed to the printed circuit board 7 with the peg elements 4.

The housing 5 includes a plurality of engaging projections 9*a*, which are spaced from each other in the longitudinal direction of the housing 5, i.e., in the direction perpendicular to the inserting direction X of the second connector 3. Each engaging projection 9*a* projects from a contact surface (also referred to as an attachment surface) 5*a* of the housing 5, which extends in the longitudinal direction of the housing 5 and is surface mounted to a mount surface 7*a* of the printed circuit board 7. It is desirable that a molding die of the housing 5 has cavity sections that form the engaging projections 9*a*, respectively, at the time of molding the housing 5 from the synthetic resin material integrally with the engaging projections 9*a* in the molding die. In such a case, the material of each engaging projection 9*a* is the same as the material (the synthetic resin material) of the housing 5. Alternatively, each engaging projection 9*a* may be made of a metal material. In such a case, the engaging projection 9*a* may be securely insert molded into the housing 5 or may be securely press fitted into the housing 5. Furthermore, in a case where the housing 5 is covered with a metal tube (or a metal sheath), each engaging projection 9*a* projects from an outer surface of the metal tube (or the metal sheath). The housing 5 includes undepicted engaging fittings (e.g., screws or protrusions), which fix the second connector 3 inserted into the housing 5.

With reference to FIG. 2, the contacts 8 are punched terminals, which are formed through punching of a metal plate with, for example, a punching machine. A middle portion of each contact 8 is embedded in the bottom portion 5*b* of the housing 5 through insert molding or press-fitting such that the contacts 8 do not interfere with each other. An extended portion of each contact 8, which extends outward from the bottom portion 5*b* of the housing 5 and is connected to the printed circuit board 7 by soldering, projects generally in parallel to the mount surface 7*a* of the printed circuit board 7 from the bottom portion 5*b* of the housing 5 and is bent in a direction that is generally perpendicular to the mount surface 7*a* of the printed circuit board 7 to extend toward the mount surface 7*a* of the printed circuit board 7. A distal end portion of the contact 8 is bent into an L-shape to form a lead terminal 6 that has a surface, which is generally parallel to a corresponding one of lands 13*a* formed on the mount surface 7*a* of the printed circuit board 7.

Each peg element 4 is formed by bending a metal strip plate into an L-shape, so that the peg element 4 has two bent surface sections, which are generally perpendicular to each other. One of these two bent surface sections of the peg element 4 is fixed to the corresponding one of the longitudinal end surfaces of the housing 5 through insert molding or press-fitting, and the other one of the two bent surface sections projects from the corresponding longitudinal end surface of the housing 5 such that the other one of the two bent surface sections is generally coplanar with the contact surface 5*a* of the housing 5, which contacts the mount surface 7*a* of the printed circuit board 7. With reference to FIG. 1, a wall of each peg element 4, which projects at a location adjacent to the corresponding longitudinal end surface of the housing 5, is configured to protect the peg element 4. The other one of the two bent surface sections of the peg element 4, i.e., a projected end portion of the peg element 4, which projects, i.e., extends from the corresponding longitudinal end surface (the corresponding end part) of the housing 5, forms a contact portion of the peg element 4. The contact portion of the peg element 4 has a contact surface, which contacts a corresponding one of lands 13*b* of the printed circuit board 7. The contact surface of the peg element 4 is made sufficiently larger than, for example, the contact surface of each lead terminal 6, which contacts the corresponding land 13*a*, to strongly hold the housing 5 relative to the printed circuit board 7. The contact portion of the peg element 4 may be effectively configured into, for example, a comb form to increase an outer peripheral edge length of the contact portion of the peg element 4.

In the present embodiment, the printed circuit board 7 does not have through-holes to fix a device thereto since a surface mount device (SMD), which does not have lead lines, is connected to corresponding lands of the printer circuit board 7 by soldering. However, in a case where the printed circuit board is a multilayer circuit board, the printed circuit board has through holes to interconnect between corresponding layers of the multilayer circuit board. As shown in FIG. 1, the printed circuit board 7 has the lands 13*a*, to which the lead terminals 6 are soldered, and the lands 13*b*, to which the peg elements 4 are soldered. Each land 13*a* is connected to a corresponding circuit pattern(s) on the printed circuit board 7. In contrast, each land 13*b* is configured into an island form (solitary island form) and is not connected to any circuit pattern on the printed circuit board 7. Furthermore, the printed circuit board 7 may have a circuit pattern(s) in a back surface 7*b* of the printed circuit board 7, which is opposite from the mount surface 7*a* of the printed circuit board 7 in a direction perpendicular to a plane (or the mount surface 7*a*) of the printed circuit board 7, in some cases.

The engaging projections 9*a* project from a predetermined area 5*a*1 of the contact surface 5*a* of the housing 5, which contacts the mount surface 7*a* of the printed circuit board 7. The predetermined area 5*a*1 of the contact surface 5*a* is located between the insertion opening 12 and the peg elements 4 in the direction parallel to the inserting direction X of the second connector 3. More specifically, the predetermined area 5*a*1 of the contact surface 5*a* is located between the insertion opening 12 and an imaginary line P of FIG. 1 in the direction parallel to the inserting direction X of the second connector 3. The imaginary line P extends in the direction perpendicular to the inserting direction X and connects between the insertion opening 12 side end part 4*a* of the one peg element 4 on the corresponding land 13*b* and the insertion opening 12 side end part 4*a* of the other peg element 4 on the corresponding land 13*b*. As discussed above, the plurality of engaging projections (multiple engaging projections) 9*a* is provided. In the present embodiment, the number of the engaging projections 9*a* is three. However, the number of the engaging projections 9*a* is not limited to three and may be changed to two or smaller than two or larger than three. For instance, a single engaging projection 9*a* may be provided, if desired. At the time of installing the first connector 2 to the printed circuit board 7, the engaging projections 9*a* are respectively inserted into through-holes 10 of the printed circuit board 7 formed at predetermined locations of the printed circuit board 7, which correspond to the engaging projections 9*a*. A distal end portion of each engaging projection 9*a* may be pointy or may have a spherical surface in order to ease insertion of the distal end portion of the engaging projection 9*a* into the corresponding through-hole 10.

Figure 5:
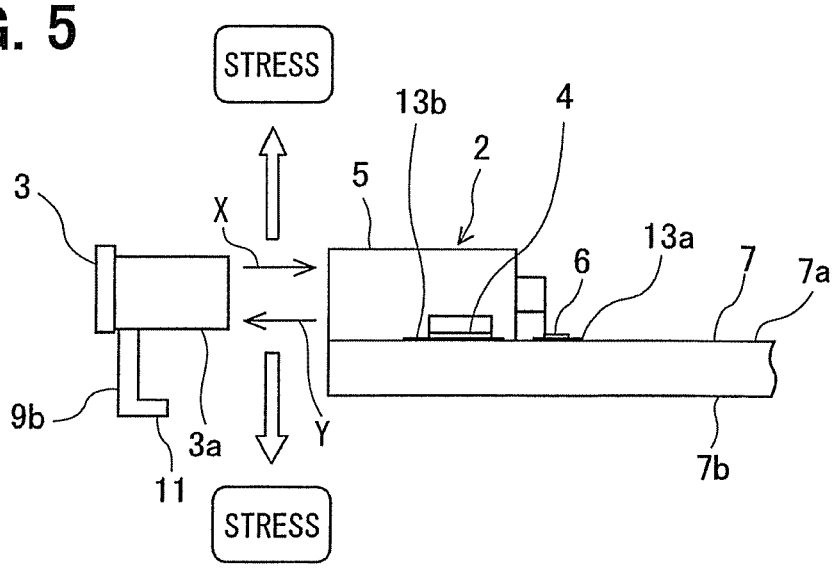
FIG. 5 is a side view of the connector apparatus of the present embodiment, showing a state where a stress is applied from the second connector to the first connector through insertion or removal of the second connector relative to the first connector.

With the above-described construction, it is possible to effectively limit (absorb) a stress (see FIG. 5), which is exerted in a direction perpendicular to the plane of the printed circuit board 7 and is caused by an inserting or removing force of the second connector 3 applied to the first connector 2 or a weight or tension of the electrical conductive line, which is connected to the second connector 3.

In order to improve the stress limiting performance (the stress absorbing performance) of the engaging projection 9*a*, a projecting length of the engaging projection 9*a*, which is measured from the contact surface 5*a* in a direction perpendicular to the contact surface 5*a*, is preferably larger than a plate thickness T of the printed circuit board 7, which is measured in the direction perpendicular to the plane of the printed circuit board 7. In this case, it may be also effective to form a deformed engaging part in a projected end portion of the engaging projection 9*a*, which projects from the back surface 7*b* of the printed circuit board 7, through deformation of the projected end portion of the engaging projection 9*a* upon melting or softening of the same with, for example, heat. Furthermore, in the case where the engaging projection 9*a* is made of the metal material, the projected end portion of the engaging projection 9*a* may be soldered to a corresponding land, which is formed in the back surface 7*b* of the printed circuit board 7. Also, a barb(s) may be formed in an outer peripheral surface (or a side surface) of the engaging projection 9*a* to limit removal of the engaging projection 9*a* from the through-hole 10 of the printed circuit board 7.

Figure 3:
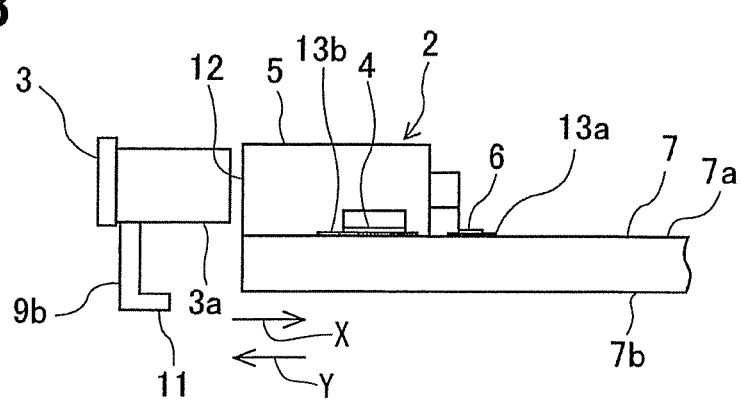
FIG. 3 is a side view of the connector apparatus of the embodiment, showing a state where the first connector is surface mounted to the printed circuit board.
Figure 4:
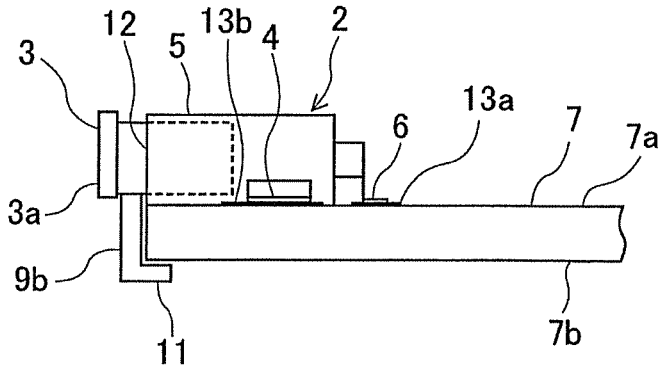
FIG. 4 is a side view of the connector apparatus of the present embodiment, showing a state where a second connector of the connector apparatus is inserted into the first connector to engage an engaging projection of the second connector with the printed circuit board.

With reference to FIGS. 1, 3 and 4, the housing 3*a* of the second connector 3 is made of a dielectric material (e.g., a synthetic resin material). The second connector 3 has the contacts (not shown) received in the housing 3*a*. The contacts 8 of the first connector 2 are inserted into the contacts of the second connector 3 at the time of inserting the second connector 3 into the first connector 2 through the insertion opening 12. The electrical conductive line, which is connected to another printed circuit board or an external electric device, is connected to the contacts of the second connector 3. The contacts of the second connector 3 are securely embedded in the housing 3*a* of the second connector 3 through the insert molding at the time of molding the housing 3*a* of the second connector 3 or press-fitting.

A plurality of engaging projections 9*b* are formed in an outer surface of the housing 3*a* of the second connector 3 in an opposite end portion of the housing 3*a* that is opposite from the inserting end portion of the housing 3*a*, which is inserted into the housing 5 of the first connector 2 through the insertion opening 12, in the direction parallel to the inserting direction X. The engaging projections 9*b* are spaced from each other in the direction perpendicular to the inserting direction X in FIG. 1 and project from the outer surface of the housing 3*a* of the second connector 3 on a side (a lower side in FIG. 3) where the printed circuit board 7 is located. In the present embodiment, the number of the engaging projections 9*b* is two. However, the number of the engaging projections 9*b* is not limited to two and may be changed to one or larger than two. A distal end portion of each engaging projection 9*b* forms a hook 11, which is bent into an L-shape. It is desirable that a molding die of the housing 3*a* of the second connector 3 has cavity sections that respectively form the engaging projections 9*b* at the time of molding the housing 3*a* of the second connector 3 from the synthetic resin material integrally with the engaging projections 9*b* in the molding die. In such a case, the material of each engaging projection 9*b* is the same as the material (the synthetic resin material) of the housing 3*a* of the second connector 3. Alternatively, each engaging projection 9*b* may be made of a metal material. In such a case, the engaging projection 9*b* may be securely insert molded into the housing 3*a* of the second connector 3 or may be securely press fitted into the housing 3*a* of the second connector 3. Furthermore, in a case where the housing 3*a* of the second connector 3 is covered with a metal tube (or a metal sheath), the engaging projection 9*b* projects from an outer surface of the metal tube (or the metal sheath). Furthermore, the second connector 3 includes undepicted engaging fittings (e.g., screws or protrusions), which limit removal of the second connector 3 from the first connector 2 after the insertion of the second connector 3 into the first connector 2.

The hook 11 of each engaging projection 9*b* is engaged with the back surface 7*b* of the printed circuit board 7 at the time of inserting the second connector 3 into the first connector 2, which is mounted to the printed circuit board 7.

With the above-described construction, it is possible to effectively limit (absorb) the stress (see FIG. 5), which is exerted to the first connector 2 in the direction perpendicular to the plane of the printed circuit board 7 and is caused by the inserting or removing force of the second connector 3 or the weight or tension of the electrical conductive line, which is connected to the second connector 3.

As discussed above, in the connector apparatus 1 of the present embodiment, at least one of the first connector 2 and the second connector 3 has the at least one engaging projection 9*a*, 9*b*, which projects from the outer surface of the connector 2, 3 (more specifically, the housing 5, 3*a* of the connector 2, 3) and is engaged with the printed circuit board 7. Thereby, the at least one engaging projection 9*a*, 9*b* effectively limits (absorbs) the stress, which is exerted to the first connector 2 in the direction perpendicular to the plane of the printed circuit board 7 and is caused by the inserting or removing force of the second connector 3 or the weight or tension of the electrical conductive line, which is connected to the second connector 3. Thus, the stress, which is applied to the lead terminals 6, is reduced, and thereby the reliability of the soldered connection of the respective lead terminals 6 is improved.

Furthermore, the engaging projections 9*a* of the first connector 2 project from the predetermined area 5*a*1 of the contact surface (attachment surface) 5*a* of the first connector 2, which is mounted to the mount surface 7*a* of the printed circuit board 7, and this predetermined area 5*a*1 of the contact surface 5*a* of the first connector 2 is located between the insertion opening 12 of the housing 5 of the first connector 2 and the peg elements 4 in the direction parallel to the inserting direction X of the second connector 3. In other words, at the mount surface 7*a* of the printed circuit board 7, the lead terminals 6 are located on one side of the peg elements 4 in the direction parallel to the inserting direction X and are spaced away from the second connector 3 in the direction parallel to the inserting direction X, and the engaging projections 9*a* are located on the other side of the peg elements 4 in the direction parallel to the inserting direction X. The engaging projections 9*a* are fitted into the through-holes 10, respectively, of the printed circuit board 7. Therefore, the stress can be more effectively limited (absorbed) by the engaging projections 9*a*. Thus, the stress, which is applied to the lead terminals 6, is reduced, and thereby the connecting reliability of the soldered connections of the lead terminals 6, which are soldered to the lands 13*a*, is improved.

Furthermore, the projecting length of each engaging projection 9*a* of the first connector 2 is larger than the plate thickness T of the printed circuit board 7. Therefore, the stress limiting performance (the stress absorbing performance) of the engaging projection 9*a* can be improved.

Furthermore, the engaging projections 9*a* of the first connector 2 are integrally molded with the housing 5 of the first connector 2 from the synthetic resin material. Therefore, the first connector 2, which has the engaging projections 9*a*, can be effectively manufactured with the minimum manufacturing steps.

Furthermore, each of the engaging projections 9*b* of the second connector 3 has the hook 11, which is engaged with the back surface 7*b* of the printed circuit board 7 at the time of inserting the second connector 3 into the first connector 2, so that the stress can be more effectively limited (absorbed) by the engaging projection 9*b*. Thus, the stress, which is applied to the lead terminals 6, is reduced, and thereby the connecting reliability of the soldered connections of the lead terminals 6, which are soldered to the lands 13*a*, is improved.

Furthermore, each engaging projection 9*b* of the second connector 3 is integrally molded with the housing 3*a* of the second connector 3 from the synthetic resin material. Therefore, the second connector 3, which has the engaging projections 9*b*, can be effectively manufactured with the minimum manufacturing steps.

Additional advantages and modifications will readily occur to those skilled in the art. The present disclosure in its broader terms is therefore not limited to the specific details, representative apparatus, and illustrative examples shown and described.

What is claimed is:

1. A connector apparatus comprising:

a first connector that is surface mounted to a mount surface of a printed circuit board through a plurality of lead terminals and at least one peg element of the first connector; and a second connector that is engageable and disengageable relative to the first connector through insertion and removal, respectively, of one of the first connector and the second connector relative the other one of the first connector and the second connector, wherein:

at least one of the first connector and the second connector includes at least one engaging projection, which projects from an outer surface of the at least one of the first connector and the second connector and is engaged with the printed circuit board;

the first connector includes the at least one engaging projection that projects from a contact surface of the first connector, which is mounted to the mount surface of the printed circuit board;

the first connector further includes an insertion opening, through which the second connector is inserted into the first connector in an inserting direction;

the at least one engaging projection of the first connector projects from a predetermined area of the contact surface of the first connector, which is located between the insertion opening of the first connector and the at least one peg element; and the at least one engaging projection of the first connector is fitted into at least one through-hole of the printed circuit board.

2. The connector apparatus according to claim 1, wherein the at least one engaging projection of the first connector has a projecting length, which is larger than a plate thickness of the printed circuit board that is measured in a direction perpendicular to a plane of the printed circuit board.

3. The connector apparatus according to claim 1, wherein the at least one engaging projection of the first connector is formed integrally with the first connector from a synthetic resin material.

4. A connector apparatus comprising:

a first connector that is surface mounted to a mount surface of a printed circuit board through a plurality of lead terminals and at least one peg element of the first connector; and a second connector that is engageable and disengageable relative to the first connector through insertion and removal, respectively, of one of the first connector and the second connector relative the other one of the first connector and the second connector, wherein:

at least one of the first connector and the second connector includes at least one engaging projection, which projects from an outer surface of the at least one of the first connector and the second connector and is engaged with the printed circuit board;

the second connector includes the at least one engaging projection; and the at least one engaging projection of the second connector has a hook that is engaged with a back surface of the printed circuit board, which is opposite from the mount surface of the printed circuit board in a direction perpendicular to a plane of the printed circuit board, when the second connector is inserted into the first connector.

5. The connector apparatus according to claim 4, wherein the at least one engaging projection of the second connector is formed integrally with the second connector from a synthetic resin material.

6. A connector apparatus comprising:

a first connector that is surface mounted to a mount surface of a printed circuit board through a plurality of lead terminals and at least one peg element of the first connector; and a second connector that is engageable and disengageable relative to the first connector through insertion and removal, respectively, of one of the first connector and the second connector relative the other one of the first connector and the second connector, wherein:

at least one of the first connector and the second connector includes at least one engaging projection, which projects from an outer surface of the at least one of the first connector and the second connector and is engaged with the printed circuit board;

the plurality of lead terminals of the first connector is soldered to a plurality of lands, respectively, each of which is formed on the mount surface of the printed circuit board and is electrically connected to a corresponding circuit pattern on the printed circuit board;

the at least one peg element includes first and second peg elements that extend from first and second end parts, respectively, of a housing of the first connector, which are opposed to each other in a direction perpendicular to an inserting direction of the one of the first connector and the second connector relative the other one of the first connector and the second connector;

each of the first and second peg elements is soldered to a corresponding land of the printed circuit board, which is formed on the mount surface of the printed circuit board and is not electrically connected to any circuit pattern on the printed circuit board;

the plurality of lead terminals of the first connector is located on one side of the first and second peg elements in a direction parallel to the inserting direction and is spaced away from the second connector in the direction parallel to the inserting direction;

the first connector includes the at least one engaging projection that projects from a contact surface of the housing of the first connector, which is mounted to the mount surface of the printed circuit board;

the at least one engaging projection of the first connector is located on the other side of the first and second peg elements, which is opposite from the one side in the direction parallel to the inserting direction; and the at least one engaging projection of the first connector is fitted into at least one through-hole of the printed circuit board.

7. The connector apparatus according to claim 6, wherein:

the housing of the first connector includes an insertion opening, through which the second connector is insertable and removable relative to the housing of the first connector;

the insertion opening of the housing of the first connector is located on the other side of the first and second peg elements in the direction parallel to the inserting direction; and the at least one engaging projection of the first connector is located between the insertion opening and the first and second peg elements in the direction parallel to the inserting direction.

* * * * *